United States Patent [19]

Suda

[11] 4,193,213

[45] Mar. 18, 1980

[54] ASTROLOGICAL FORTUNE-TELLING DEVICE

[75] Inventor: Kataro Suda, Tokyo, Japan

[73] Assignee: Suda Kinzoku Seisakusho Co. Ltd., Tokyo, Japan

[21] Appl. No.: 922,976

[22] Filed: Jul. 10, 1978

[30] Foreign Application Priority Data

Oct. 13, 1977 [JP] Japan ..... 52-122878

[51] Int. Cl.[2] ..... G09B 29/00; A63F 9/18

[52] U.S. Cl. ..... 35/44; 273/161

[58] Field of Search ..... 35/43, 44; 273/161

[56] References Cited

U.S. PATENT DOCUMENTS

| | | | |
|---|---|---|---|
| 1,019,663 | 3/1912 | Kuester | 35/44 |
| 2,219,378 | 10/1940 | Booth | 35/44 |
| 3,355,822 | 12/1967 | Losey | 35/44 |
| 3,863,365 | 2/1975 | Moliard | 35/44 |
| 3,992,787 | 11/1976 | Lynch | 35/44 |

FOREIGN PATENT DOCUMENTS

| | | | |
|---|---|---|---|
| 13748 | of 1891 | United Kingdom | 35/44 |

*Primary Examiner*—William H. Grieb

[57] ABSTRACT

An astrological fortune-telling device is comprised of a base plate having twelve houses, a rotatable plate provided with the twelve depicted constellation signs, orbits for placement of markings corresponding to planets, a transparent cover, and a transparent rotatable disk provided with fan-shape areas.

8 Claims, 4 Drawing Figures

ASTROLOGICAL FORTUNE-TELLING DEVICE

BACKGROUND OF THE INVENTION

This invention relates to an astrological fortune-telling device for the western or solar astrology, by which very complicated calculations and operations based on various divinatory factors may be eliminated by convenient movements of a few elements for obtaining a rapid and correct divinatory result.

Heretofore, the western or solar astrological fortune-telling has been practised by preparing a birth zodiac in accordance with a first factor of positions of the sun and the nine planets around the earth in relation to the date and time of one's birth and with a second factor of a geographic place of one's birth. In the preparation of the accurate birth zodiac, the first factor in relation to the date and time of one's birth has been determined with use of a celestial almanac to prepare the first zodiac and then the second factor of the geographic place of one's birth has been taken into consideration in order to calculate the actual planetary positions based on the birth place and to correct the first zodiac into the actual birth zodiac. In this procedure, however, the preparation of the first zodiac and the correction thereof are extremely troublesome and time-consuming.

With the foregoing in mind, the present invention provides a fortune-telling device for astrology, by which the accurate birth zodiac may be easily and rapidly prepared by convenient movements of a few elements but without any complicated calculations and corrections.

SUMMARY OF THE INVENTION

It is, therefore, the principal object of the invention to provide an astrological fortune-telling device which comprises a base plate having twelve divisions of houses, a plate which is provided with the twelve depicted constellation signs and mounted rotatably on a center of the twelve divisions of the base plate, orbits concentrically arranged around the center for placement of markings which correspond to the sun and the planets excluding the earth at any position, a transparent cover placed over the base plate and the rotatable plate and a transparent rotatable disk provided with fan-shape areas which is surmounted removably on the transparent cover and rotatably in relation to the center of the rotatable plate.

In an astrological fortune-telling device according to the invention, the markings corresponding to the sun and the planets to be placed on the orbits are preferably formed as discriminatingly colored spherical bodies in order to distinguish these planets at a glance, and for easy placement and movement of the markings the orbits may be formed as concentrical grooves with the markings being mounted slidably along the grooves. Alternatively, either one of the orbits or the markings may be constituted as magnets while the other one may be made of iron.

Further, in an astrological fortune-telling device according to the invention, the transparent cover must be removed in order to set the rotatable plate and the markings in position and for this purpose the transparent cover may be placed in a completely removable manner, or in a open-closable manner over the base plate and the rotatable plate.

Still further, in a device according to the invention, the fan-shape areas depicted on the transparent rotatable disk may be preferably colored transparently and discriminatingly for a convenient fortune-telling by means of these different colors.

According to the invention, the correction of the first zodiac into the actual birth zodiac may be carried out much more easily and rapidly than any other conventional methods requiring troublesome and time-consuming calculations, and the corrected birth zodiac suggests a direct ascendant for a person, thereby permitting extremely easy and rapid fortune-telling.

Further, no error in the calculations and corrections of the planetary positions takes place because of the simple operation of the device. In particular, the device of the invention has such advantages that neither drawing of the planetary positions on a paper nor redrawing thereof based on the correction is ever required and that the planetary positions may be easily and surely observed through the transparent cover and the transparent rotatable disk so that the important factors of the planetary phases may be observed at a glance. As a result, even a beginner or an unskilled person can tell fortune very easily and rapidly with use of the device of the invention.

BRIEF DESCRIPTION OF THE DRAWING

One way of carrying out the invention is described in detail below with reference to drawings which illustrate specific embodiments, in which.

DESCRIPTION OF THE PREFERRED EMBODIMENTS

Figure 1:
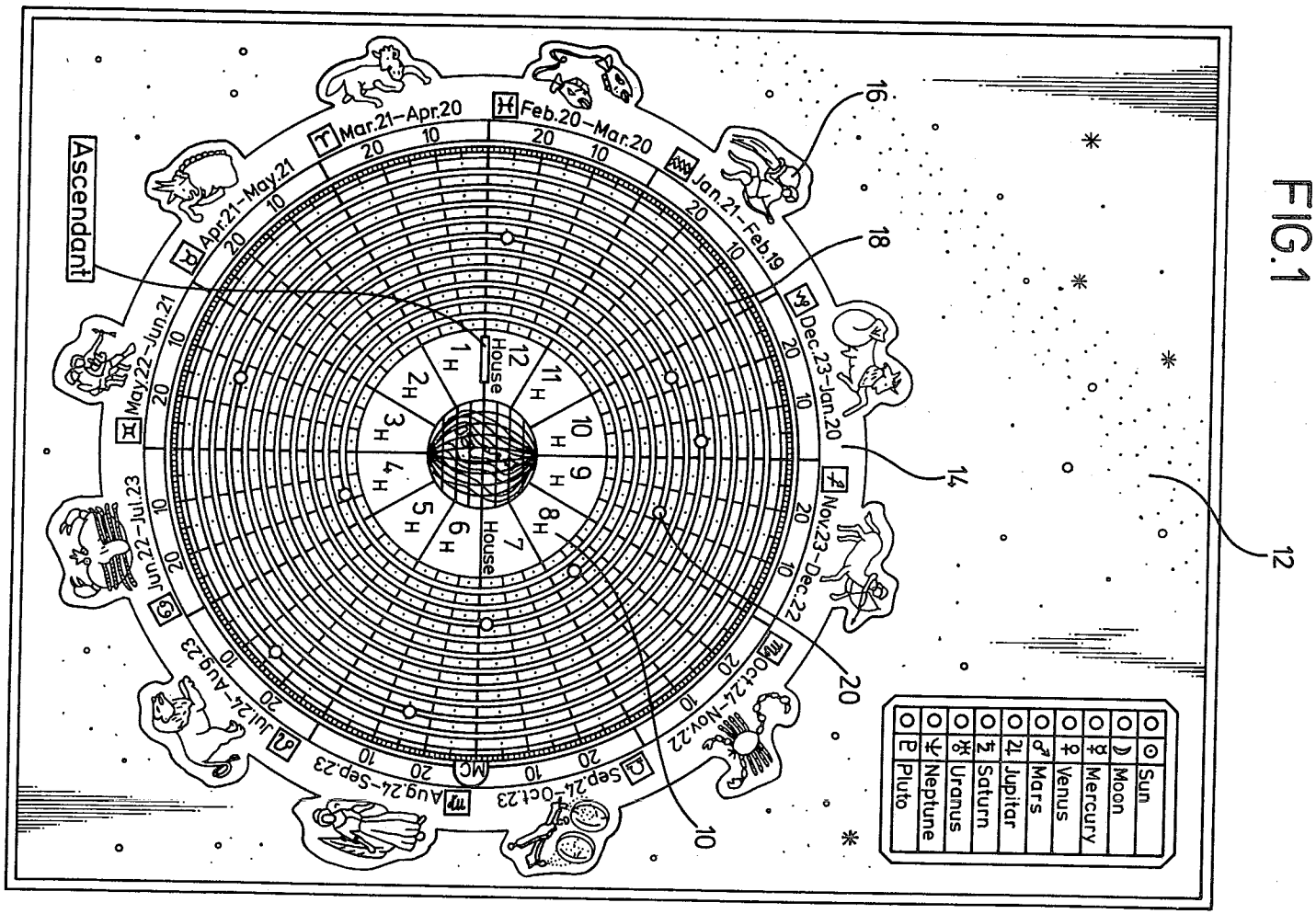
FIG. 1 is a plan view of the rotatable plate with the base plate according to the invention.
Figure 2:
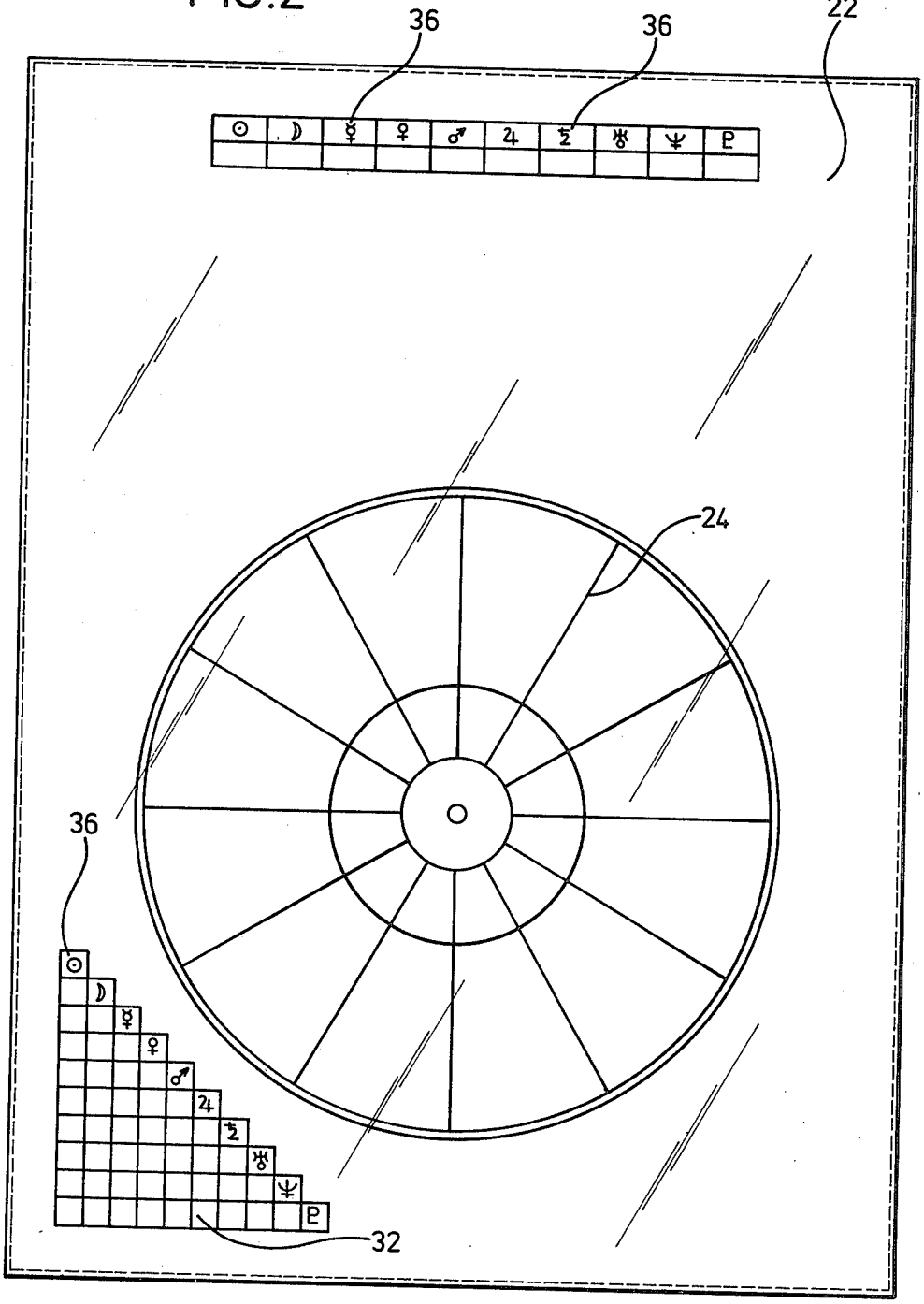
FIG. 2 is a plan view of the transparent cover.
Figure 3:
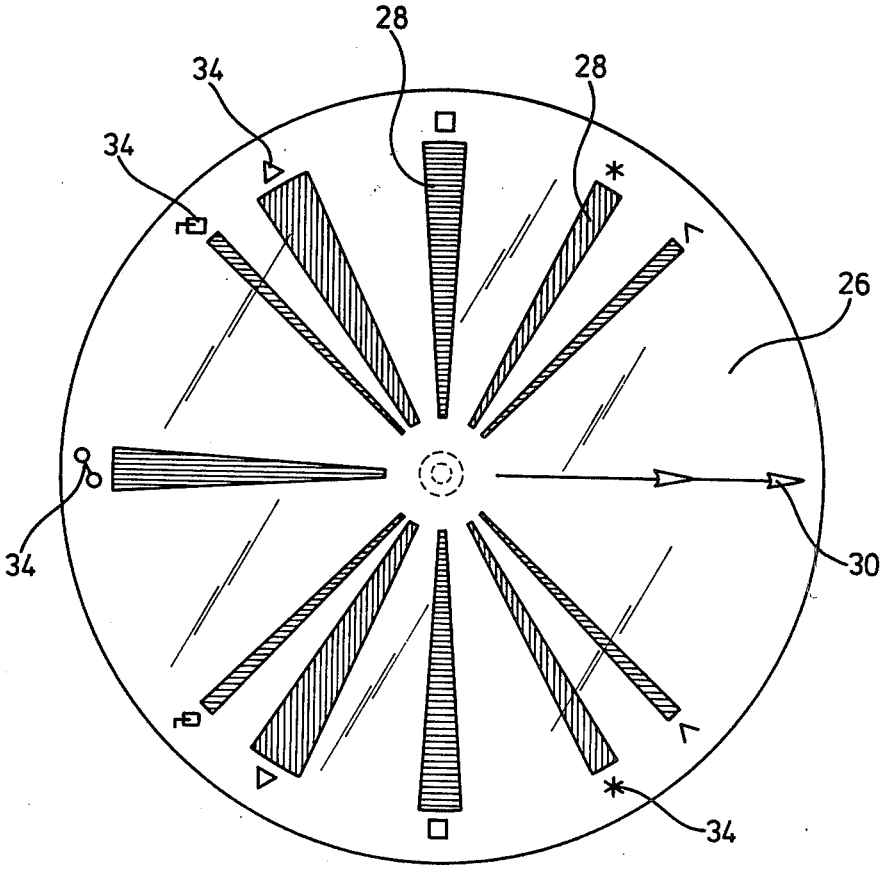
FIG. 3 is a plan view of the transparent rotatable disk.
Figure 4:
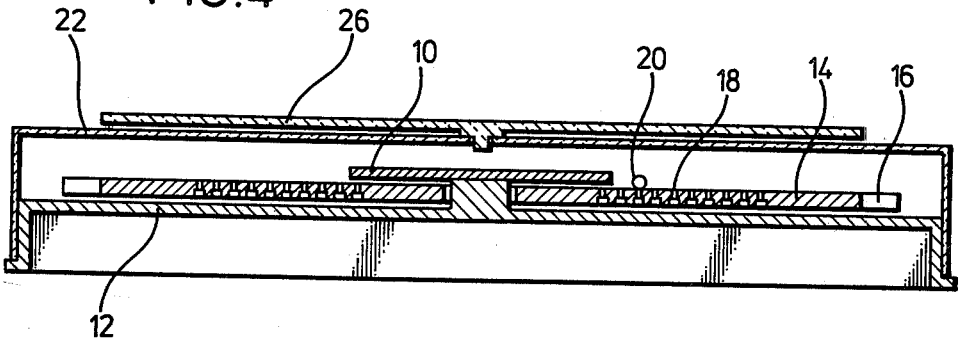
FIG. 4 is a front sectional view of the whole assembly.

In FIGS. 1 and 4, the astrological fortune-telling device according to the invention includes twelve divisions of houses 10 arranged around a center of a base plate 12 on which a plate 14 is rotatably arranged for turning around the center of the twelve divisions of houses 10.

In the rotatable plate 14 at its circumference are depicted twelve constellation signs 16 with arrangement of ten concentrical orbits 18 for the sun and the nine planets excluding the earth. The orbits 18 may have at any position the discriminatingly colored markings 20, each of which corresponds to the respective planet.

Over the base plate 12 and the rotatable 14 is placed a transparent cover 22 so as not to touch the plate 14 and markings 20 thereon. The cover 22 is mounted in a completely removable manner or in an open-closable manner in relation to the base plate 12 and the rotatable plate 14. The transparent cover 22 has the twelve divided areas 24 around the rotatory axis of the rotatable plate 14, and a transparent rotatable and removable disk 26 is surmounted on the cover 22 so as to turn around the center of the twelve areas 24.

In the transparent rotatable disk 26 are provided transparently colored fan-shape areas 28.

The reference numeral 30 represents a fundamental marking provided in the transparent rotatable disk 26 and 32 is a recording column for noting the relationship of the relative phases of the planets. The position of each planet may be marked on the transparent cover 22 with a erasable writing means and the relative phases of the planets are noted on the recording column 32.

Alternatively, these marks and notes may be given by temporarily attaching markers on the cover 22 and the column 32. After having terminated the fortune-telling, those marks and notes may be eliminated. The reference numerals 34 stand for symbols representing the phases of the planets and 36 represent the symbols of the planets per se. The fortune, destiny and the like corresponding to the phases of the planets and to the positions of the planets on the celestial body may be listed in another table, apart from the device according to the invention.

In one embodiment, the illustrated orbits are concentrical circular grooves, and the spheric markings showing the planets with different colors may be moved along the grooves, altho the invention is not restricted to this construction. For example, either one element of the rotatable plate 14 or the marking 20 may be of magnetic material and the other element may be made of iron so that the both elements may be magnetically pulled against each other.

In operation of the device according to the invention, the positions of the sun and the nine planets (excluding the earth on the celestial body) are determined in relation to the date and time of one's birth by means of the celestial almanac such as the Greenwich standard calendar, and then the markings 20 corresponding to the planets are placed at the respective positions of the orbits 18 of the rotatable plate 14. When a difference exists between the actual place of one's birth and the Greenwich employed as the standard place, it may be corrected by turning the rotatable plate 14 in an angle indicated by or calculated from the correction table separately prepared, and thus the planets are correctly situated on the positions of the celestial body, depending on the date and time, as well as the place of one's birth.

Thus according to the device, it is unnecessary to correct the position of each planet individually. Namely, the correction may be easily achieved by turning the rotatable plate 14 only once. The corrected birth zodiac suggests a direct ascendant for a person.

As hereinbefore described, the device of the invention involves the transparent cover 22 positioned over the fundamental components comprising the base plate 12 with the twelve divisions of houses 10 and the rotatable plate 14 for easy correction. In other words, the device of the invention represents the so-called "progress chart" on the transparent cover 22 or on the rotatable plate 14 in addition to the birth zodiac, the positions of the planets on the progress chart being compared with those on the birth zodiac by viewing through the transparent cover 22. Thus, the relationship between the planetary phase of the birth zodiac and that of the progress chart may be observed very easily.

Further, in the device of the invention the transparent rotatable disk 26 may be removed from the transparent cover 22 when the angle or relative phase is required between the planetary positions on the birth zodiac and those on the progress chart. Moreover, in the transparent rotatable disk 26 may be arranged the transparently colored fan-shape areas 28, the colors of which may be varied depending on good or ill luck, for example red or pink color for good fortune and blue color for ill luck. The transparent rotatable disk 26 provided with the thus-colored fan-shape areas 28 permits very easy operation of the fortune-telling device of the invention.

The description hereinbefore is to be considered as illustrative and not limitative as many changes and modifications may be made without departing from the spirit and scope of the invention.

What we claim is:

1. An astrological fortune-telling device which comprises a base plate having twelve divisions of houses, a plate which is provided with the twelve depicted constellation signs and mounted rotatably on a center of the twelve divisions of said base plate, orbits concentrically arranged around said center for placement of markings which correspond to the sun and the planets excluding the earth at any position, a transparent cover placed over said base plate with said rotatable plate, and a transparent disk provided with fan-shape areas which is surmounted removably on said transparent cover and rotatable in relation to the center of said rotatable plate.

2. An astrological fortune-telling device as claimed in claim 1, in which the transparent cover is placed in a completely removable manner or in an open-closable manner in relation to the base plate and the rotatable plate.

3. An astrological fortune-telling device as claimed in claim 1 or claim 2, in which the fan-shape areas provided in the transparent rotatable disk are colored transparently and discriminatingly for a convenient fortune-telling.

4. An astrological fortune-telling device as claimed in claim 3, in which the orbits are formed as concentric grooves and the markings are placed slidably along the grooves.

5. An astrological fortune-telling device as claimed in claim 3, in which either one of the orbit or the markings comprises a magnet and the other one is made of iron.

6. An astrological fortune-telling device as claimed in claim 1 or 2, in which the orbits are formed as concentric grooves and the markings are placed slidably along the grooves.

7. An astrological fortune-telling device as claimed in claim 1 or 2, in which either one of the orbits or the markings is constituted of magnet and the other one is made of iron.

8. An astrological fortune-telling device as claimed in claim 1, in which the markings are formed as discriminatingly colored spherical bodies.

* * * * *